US010861616B2

(12) United States Patent
Zhang et al.

(10) Patent No.: US 10,861,616 B2
(45) Date of Patent: Dec. 8, 2020

(54) CABLES EXHIBITING INCREASED AMPACITY DUE TO LOWER TEMPERATURE COEFFICIENT OF RESISTANCE

(71) Applicants: Shenjia Zhang, Zionsville, IN (US); Sathish Kumar Ranganathan, Avon, IN (US); Keerti Sahithi Kappagantula, Athens, OH (US); Frank F. Kraft, Albany, OH (US)

(72) Inventors: Shenjia Zhang, Zionsville, IN (US); Sathish Kumar Ranganathan, Avon, IN (US); Keerti Sahithi Kappagantula, Athens, OH (US); Frank F. Kraft, Albany, OH (US)

(73) Assignees: General Cable Technologies Corporation, Highland Heights, KY (US); Ohio University, Athens, OH (US)

( * ) Notice: Subject to any disclaimer, the term of this patent is extended or adjusted under 35 U.S.C. 154(b) by 0 days.

(21) Appl. No.: 16/514,785

(22) Filed: Jul. 17, 2019

(65) Prior Publication Data

US 2020/0027624 A1 Jan. 23, 2020

Related U.S. Application Data

(60) Provisional application No. 62/702,116, filed on Jul. 23, 2018.

(51) Int. Cl.

| | |
|---|---|
| ***H01B 1/02*** | (2006.01) |
| ***H01B 1/04*** | (2006.01) |
| ***H01B 13/00*** | (2006.01) |

(52) U.S. Cl.

CPC ..... *H01B 1/026* (2013.01); *H01B 1/04* (2013.01); *H01B 13/0016* (2013.01); *H01B 13/0036* (2013.01)

(58) Field of Classification Search

CPC . H01B 1/04; H01B 1/026; H01B 1/02; H01B 13/0036; H01B 13/0016

See application file for complete search history.

(56) References Cited

U.S. PATENT DOCUMENTS

| | | | | |
|---|---|---|---|---|
| 3,323,882 | A | 6/1967 | Albert | |
| 10,685,760 | B2 | 6/2020 | Zhang et al. | |
| 2009/0008779 | A1 | 1/2009 | Suhir et al. | |
| 2012/0077017 | A1* | 3/2012 | Buresch | B22F 3/115 428/312.8 |
| 2012/0152480 | A1* | 6/2012 | Nayfeh | B22D 17/14 164/61 |
| 2016/0118157 | A1* | 4/2016 | Holesinger | H01B 3/30 428/366 |
| 2016/0151817 | A1* | 6/2016 | Nayfeh | B21C 37/047 29/599 |
| 2016/0168693 | A1* | 6/2016 | Schmidt | H01B 1/04 427/117 |
| 2016/0368035 | A1 | 12/2016 | Kobayashi | |
| 2018/0102197 | A1 | 4/2018 | Adams | |
| 2018/0339492 | A1 | 11/2018 | Aytug et al. | |

FOREIGN PATENT DOCUMENTS

| | | | |
|---|---|---|---|
| CN | 107245590 | A | 10/2017 |
| FR | 3016727 | A1 | 7/2015 |
| WO | 2017046038 | A1 | 3/2017 |
| WO | 2018064137 | A1 | 4/2018 |

OTHER PUBLICATIONS

Vanier, Cecile; Extended European search report including the European search report and the European search opinion, issued in European Patent Application No. 19187487.4; dated Dec. 6, 2019; 5 pages.

* cited by examiner

*Primary Examiner* — Timothy J Thompson
*Assistant Examiner* — Amol H Patel
(74) *Attorney, Agent, or Firm* — Ulmer & Berne LLP

(57) ABSTRACT

Cables including conductors formed form ultra-conductive copper wires which have a lower temperature coefficient of resistance are disclosed. Methods of making the cables including conductors with ultra-conductive copper wires are further disclosed.

14 Claims, No Drawings

CABLES EXHIBITING INCREASED AMPACITY DUE TO LOWER TEMPERATURE COEFFICIENT OF RESISTANCE

CROSS-REFERENCE TO RELATED APPLICATIONS

The present application claims the priority of U.S. Provisional Patent Application Ser. No. 62/702,116, entitled CABLES EXHIBITING INCREASED AMPACITY DUE TO LOWER TEMPERATURE COEFFICIENT OF RESISTANCE, filed Jul. 23, 2018, and hereby incorporates the same application herein by reference in its entirety.

TECHNICAL FIELD

The present disclosure generally relates to cables exhibiting increased ampacity and including wires that have a lower temperature coefficient of resistance than wires formed of pure copper.

BACKGROUND

The operating temperature of a cable is determined by the cumulative effect of heating and cooling on the cable including heat generated through conductor resistance losses, heat absorbed from external sources, and heat emitted away from the cable through conduction, convection, and radiation. In turn, the ampacity (e.g., the current-carrying capacity) of the cable is dependent on the operating temperature. For cables formed of conventional conductive materials, such as Unified Number System ("UNS") 110 copper or UNS 101 copper as defined by ASTM International and SAE International, the cable's electrical resistance increases as the temperature of the conductor(s) rises.

Ultra-conductive metals refer to alloys or composites which exhibit greater electrical conductivity than the pure metal from which the ultra-conductive metal is formed. Ultra-conductive metals are produced through the incorporation of certain, highly conductive, additives into a pure metal to form an alloy or composite with improved electrical conductivity. For example, ultra-conductive copper can be formed through the incorporation of highly conductive nano-carbon particles, such as carbon nanotubes and/or graphene, into high purity copper.

SUMMARY

In accordance with one embodiment, a cable includes a conductor including one or more wires formed from ultra-conductive copper. The ultra-conductive copper is formed from pure copper and a nano-carbon additive. The one or more wires exhibits a lower temperature coefficient of resistance than wires formed from only pure copper.

In accordance with another embodiment, a method of forming a cable with a lower temperature coefficient of resistance includes depositing a non-carbon additive onto a plurality of copper metal pieces, processing the plurality of copper metal pieces together to form ultra-conductive copper; drawing the ultra-conductive into one or more wires; and forming a cable from the one or more wires.

DETAILED DESCRIPTION

The temperature of a conductor is dependent on a number of influences including the electrical properties of the conductor, the physical properties of the conductor, the operation of the conductor, and local weather conditions. Generally, as the temperature of a cable rises, the ampacity decreases due to the resistance of the conductor being dependent upon temperature. It has presently been discovered that the resistance of ultra-conductive metals can unexpectedly decrease the rate at which resistance rises with increasing temperature (e.g., exhibit a lowered temperature coefficient of resistance) and that cables having conductors with wires formed of such ultra-conductive metals can exhibit higher ampacity at elevated temperatures. Cables incorporating wires formed of such ultra-conductive metals can have higher ampacity because the cable's electrical resistance rises at a lower rate with respect to temperature than cables formed with comparative conventional conductor metals. Cables including such ultra-conductive metals are disclosed herein.

As can be appreciated, ultra-conductive metals, such as ultra-conductive copper, exhibit greater conductivity than the pure metal through the incorporation of nano-carbon additives. For example, a wire formed from ultra-conductive copper can exhibit an International Annealed Copper Standard ("IACS") conductivity of greater than 100% despite the decreased purity of the copper (which would conventionally lower the electrical conductivity). As can be appreciated, a wire formed from conventional purity copper has a conductivity of about 100% IACS with ultrapure copper (e.g., 99.9% or greater purity) rising to an IACS of about 101% and copper alloys having an IACS of less than 100% IACS. As used herein, 100% IACS corresponds to an electrical conductivity of 58.001 MS/m.

It is believed that the decrease in the temperature coefficient of resistance for ultra-conductive metals is caused by the inclusion of the nano-carbon additives within the ultra-conductive metal. Specifically, it is believed that the nano-carbon additives have a smaller temperature coefficient of resistance than the pure metal and can lower the temperature coefficient of resistance of the entire ultra-conductive metal. Unexpectedly however, the decrease in temperature coefficient of resistance for the ultra-conductive metal is greater than the increase attributable only to the nano-carbon additives alone suggesting a previously unrecognized synergistic effect is occurring between the nano-carbon additives and the metal. Specifically, a relative increase of 1.47% IACS conductivity was observed in a sample including 0.001%, by weight, graphene. As can be appreciated, this improvement is greater than the effect attributable to the law of mixture. The decrease in the temperature coefficient of resistance increases as the weight percentage of the nano-carbon additives in the ultra-conductive metal increases.

Generally, suitable ultra-conductive metals used for the wires in the conductors for the cables described herein can be made through any known process which incorporates nano-carbon additives into a pure metal. As used herein, a pure metal means a metal having a high purity such as about 99% or greater purity, about 99.5% or greater purity, about 99.9% or greater purity, or about 99.99% or greater purity. As can be appreciated, purity can alternatively be measured using alternative notation systems. For example, in certain embodiments, suitable metals can be 4N or 5N pure which refer to metals having 99.99% and 99.999% purity, respectively. As used herein, purity can refer to either absolute purity or metal basis purity in certain embodiments. Metal basis purity ignores non-metal elements when assessing purity. As can be appreciated, certain impurities having a conductivity lower than copper can lower the electrical conductivity of the ultra-conductive metal.

Known methods of forming suitable ultra-conductive metals for the cables described herein can include deformation processes, vapor phase processes, solidification processes, and composite assembly from powder metallurgy processes. In certain embodiments, deposition methods can advantageously be used to form the ultra-conductive metals as such processes form large quantities of the ultra-conductive metals and can form such ultra-conductive metals with suitable quantities of nano-carbon additives. Generally, the deposition methods described herein can deposit nano-carbon onto metal pieces which are then processed together to form a larger mass or bulk ultra-conductive metal.

As can be appreciated, the deposition method described herein can be modified in a variety of ways. For example, the initial metal pieces can be metal plates, sheets, films, foils, or cross-sectional slices of rods, bars, and the like. Generally, such metal pieces can be prepared from a high purity metal and then cleaned to remove contaminants as well as any oxidation. For example, submersion in acetic acid can remove oxidation that would otherwise affect adhesion and interfacial resistance between copper and nano-carbon.

In certain embodiments of the disclosed deposition methods, graphene can be directly deposited on the surfaces of metal pieces using a chemical vapor deposition (CVD) process. In such embodiments, the metal profiles can be placed in a heated vacuum chamber and then a suitable graphene precursor gas, such as methane, can be introduced such that decomposition of the methane can form graphene. As can be appreciated however, other deposition processes can alternatively be used. For example, other known chemical vapor deposition processes can be used to deposit graphene or other nano-carbon additives such as carbon nanotubes. Alternatively, other deposition processes can be used. For example, nano-carbon particles can alternatively be deposited from a suspension of the nano-carbon additive in a solvent.

Additional details about exemplary methods of forming ultra-conductive metals which can be improved by the methods described herein are disclosed in PCT Patent Publication No. WO 2018/064137 which is hereby incorporated herein by reference. As can be appreciated, ultra-conductive metals can alternatively be commercially obtained.

In certain embodiments, the ultra-conductive metals can include any known nano-carbon additives. For example, in certain embodiments, the nano-carbon additives can be carbon nanotubes and/or graphene. The highly conductive additives can be included in the metal in any suitable quantity including about 0.0005%, by weight, or greater, about 0.0010%, by weight, or greater, about 0.0015%, by weight, or greater, about 0.0020%, by weight or greater, or about 0.0005%, by weight, to about 0.1%, by weight.

In certain embodiments, cables can include conductors with one or more ultra-conductive wires. In certain embodiments, the ultra-conductive wires can be formed from ultra-conductive copper.

As can be appreciated, ultra-conductive metals can also, or alternatively, replace the conductive elements of other applications which already require high electrical conductivity, and which would benefit from even greater ampacity. For example, ultra-conductive metals can be useful to form the conductive elements of wires/cables, electrical interconnects, and any components formed thereof such as cable transmission line accessories, integrated circuits, and the like. Replacement of conventional copper, or other metals, in such applications can allow for immediate improvement in ampacity without requiring redesign of the systems.

EXAMPLES

Ultra-conductive copper wires were produced to evaluate the temperature coefficient of resistance. The ultra-conductive copper wires were formed using a deposition process followed by extrusion. Specifically, the ultra-conductive copper wires were formed by depositing graphene on cross-sectional slices of a 0.625 inch diameter copper rod formed of 99.9% purity copper (UNS 11010 copper). The cross-sectional slices, or discs, had a thickness of 0.0007 inch. The cross-sectional slices were cleaned in an acetic acid bath for 1 minute.

Graphene was deposited on the cross-sectional slices using a chemical vapor deposition ("CVD") process. For the CVD process, the cross-sectional slices were placed in a vacuum chamber having a vacuum pressure of 50 mTorr, or less, and then purged with hydrogen for 15 minutes at 100 $cm^3$/min to purge any remaining oxygen. The vacuum chamber was then heated to a temperature of 900° C. to 1,100° C. over a period of 16 to 25 minutes. The temperature was then held a further 15 minutes to ensure that the cross-sectional slices reached equilibrium temperature. Methane and inert carrier gases were then introduced at a rate of 0.1 L/min for 5 to 10 minutes to deposit graphene on the surfaces of the cross-sectional slices.

Multiple graphene covered cross-sectional slices were formed into a wire by stacking the graphene covered cross-sectional slices and wrapping them in copper foil. The wrapped stack was then extruded at 700° C. to 800° C. in an inert nitrogen atmosphere using a pressure of 29,000 psi over about 30 minutes. The extruded wires had a diameter of 0.808 inches and varying amounts of graphene.

Table 1 depicts the electrical conductivity and ampacity of ultra-conductive copper wires. Example 1 is a control formed with no graphene. Example 2 includes 0.000715%, by weight, graphene. Example 3 includes 0.001192%, by weight, graphene. Example 4 includes 0.001669%, by weight, graphene. Ampacity was measured by loading the sample wire into an enclosure maintained at room temperature (e.g., at about 23° C.). The sample wire was connected to a current source and the wire temperature with monitored with a thermocouple or an infrared thermometer. Current was applied and adjusted until the wire reached and maintained a target temperature (20° C. or 60° C.). The ampacity was then measured.

TABLE 1

| Example | Graphene (weight percent) | Conductivity at 20° C. (% IACS) | Conductivity at 60° C. (% IACS) | Ampacity (Amps per $mm^2$) at 60° C. |
|---|---|---|---|---|
| Example 1 | — | 101.81% | 80.22% | 14.85 |
| Example 2 | 0.000715% | 102.70% | — | — |
| Example 3 | 0.001192% | 103.10% | 81.40% | 15.21 |
| Example 4 | 0.001669% | 103.60% | 82.39% | 15.63 |

Table 2 depicts the percentage increase in conductivity for Examples 2 to 4 when compared to Example 1.

TABLE 2

| Example | Relative Increase in Conductivity at 20° C. | Relative Increase in Conductivity at 60° C. |
|---|---|---|
| Example 2 | 0.87% | — |
| Example 3 | 1.27% | 1.47% |
| Example 4 | 1.76% | 2.71% |

As depicted in Table 2, the inclusion of graphene in Examples 3 and 4 lowered the temperature coefficient of resistance as indicated by a higher relative increase in conductivity at 60° C. compared to the relative increase in conductivity at 20° C. As indicated in Table 1, this difference allows cables formed of Examples 3 and 4 to conduct a greater amount of amperage per square millimeter.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross-referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of a term in this document conflicts with any meaning or definition of the same term in a document incorporated by reference, the meaning or definition assigned to that term in the document shall govern.

The foregoing description of embodiments and examples has been presented for purposes of description. It is not intended to be exhaustive or limiting to the forms described. Numerous modifications are possible in light of the above teachings. Some of those modifications have been discussed and others will be understood by those skilled in the art. The embodiments were chosen and described for illustration of ordinary skill in the art. Rather it is hereby intended the scope be defined by the claims appended various embodiments. The scope is, of course, not limited to the examples or embodiments set forth herein, but can be employed in any number of applications and equivalent articles by those of hereto.

What is claimed is:

1. A cable comprising:

a conductor comprising one or more wires formed from ultra-conductive copper; and wherein the ultra-conductive copper is formed from pure copper and a nano-carbon additive;

wherein the ultra-conductive copper comprises about 0.0005%, by weight, to about 0.1%, by weight, of the nano-carbon additive; and wherein the one or more wires exhibit a lower temperature coefficient of resistance than wires formed from only pure copper.

2. The cable of claim 1, wherein the nano-carbon additive comprises a carbon nanotube, graphene, or a combination thereof.

3. The cable of claim 1, wherein the ultra-conductive copper comprises about 0.0010%, by weight, to about 0.1%, by weight, of the nano-carbon additive.

4. The cable of claim 1, wherein the pure copper comprises a metal basis purity of about 99% or greater.

5. The cable of claim 1, wherein pure copper comprises an absolute purity of about 99% or greater.

6. The cable of claim 1, wherein the one or more wires exhibit an International Annealed Copper Standard ("IACS") conductivity of about 100.5% or greater.

7. The cable of claim 1 exhibits a lower temperature coefficient of resistance than an identical cable formed without the nano-carbon additive.

8. A method of forming a cable with a lower temperature coefficient of resistance, comprising:

depositing a nano-carbon additive onto a plurality of copper metal pieces;

processing the plurality of copper metal pieces together to form ultra-conductive copper;

drawing the ultra-conductive copper into one or more wires; and forming a cable from the one or more wires;

wherein the ultra-conductive copper comprises about 0.0005%, by weight, to about 0.1%, by weight, of the nano-carbon additive.

9. The method of claim 8, wherein the nano-carbon additive is deposited with a chemical vapor deposition process or a solvent deposition process.

10. The method of claim 8, wherein the ultra-conductive copper comprises about 0.0010%, by weight, to about 0.1%, by weight, of the nano-carbon additive.

11. The method of claim 8, wherein the copper metal pieces comprise a metal basis purity of about 99% or greater copper.

12. The method of claim 8, wherein the copper metal pieces comprise an absolute purity of about 99% or greater copper.

13. The method of claim 8, wherein the cable exhibits an ampacity of about 15 amps or greater per $mm^2$ when the operating temperature of the cable is about 60° C. or greater and the ambient temperature is about 23° C.

14. A cable comprising:

a conductor comprising one or more wires formed from ultra-conductive copper; and wherein the ultra-conductive copper is formed from pure copper and a nano-carbon additive;

wherein the one or more wires exhibit a lower temperature coefficient of resistance than wires formed from only pure copper; and wherein the one or more wires exhibit an ampacity of about 15 amps or greater per $mm^2$ when the operating temperature of the cable is about 60° C. or greater and the ambient temperature is about 23° C.

* * * * *